US006276269B1

(12) United States Patent
Bravenec

(10) Patent No.: US 6,276,269 B1
(45) Date of Patent: Aug. 21, 2001

(54) GUIDE ROLL FOR USE IN PRINTING LENTICULAR MATERIALS

(75) Inventor: Daniel W. Bravenec, Irving, TX (US)

(73) Assignee: Lenticular Technologies, LLC, Irving, TX (US)

( * ) Notice: Subject to any disclaimer, the term of this patent is extended or adjusted under 35 U.S.C. 154(b) by 0 days.

(21) Appl. No.: 09/391,327

(22) Filed: Sep. 7, 1999

(51) Int. Cl.[7] ..... B41F 5/06; B41F 5/16

(52) U.S. Cl. ..... 101/178; 101/219; 101/481; 101/485

(58) Field of Search ..... 226/52, 59; 101/174, 101/176, 178, 183, 212, 216, 219, 248, 481, 485

(56) References Cited

U.S. PATENT DOCUMENTS 4,566,162 * 1/1986 Brands ..... 26/105
5,421,259 * 6/1995 Shiba et al. ..... 101/232
5,601,020 * 2/1997 Dawley et al. ..... 101/217
5,927,198 * 7/1999 Tada ..... 101/420
5,967,032 * 10/1999 Bravenec et al. ..... 101/211

* cited by examiner

*Primary Examiner*—Daniel J. Colilla
(74) *Attorney, Agent, or Firm*—Polster, Lieder, Woodruff & Lucchesi, LC

(57) ABSTRACT

A guide roll (22, 24) for a printing press (10) printing an image on a flat surface (16) of a web (12) of a lenticular lens material. The other side of the material has a series of lenticules (14) formed on it which extend parallel of each other longitudinally of the web and generally across the width of the web. The surface on which the lenticules are formed is drawn across the guide roll as the web of material is pulled through the press. The guide roll has a band (B) of circumferentially extending grooves (G) formed on an outer surface (26) of the roller. The grooves are formed so at least one lenticule fits in each groove. Thus, as the web is drawn through the press, and across the idler roller, the grooves prevent both lateral movement of the web with respect to the press, and distortion of the web. This helps maintain a printing alignment established between the printing press and the web of material prior to beginning a print run.

19 Claims, 3 Drawing Sheets

GUIDE ROLL FOR USE IN PRINTING LENTICULAR MATERIALS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to the printing of lenticular materials, and more particularly, to a guide such as an idler roll or impression roll installed on a printing press and formed for use in guiding a sheet of lenticular material through the printing press. The guide roll eliminates lateral movement of the lenticular material as it moves through the press so, and other possible distortion of the web, to enhance the quality of the resulting printed materials.

In U.S. patent application Ser, No. 09/082,715, now U.S. pat. No. 5,967,032, the teachings of which are incorporated herein by reference, there is described a printing process for flexographic printing of a thin sheet lenticular material. As noted therein at page 3, lines 21–23, "the quality of a printing operation has been found to be best controlled by meticulously controlling the alignment of the film, printing plates, and lens material prior to the start of printing". Once a printing operation has begun, it is important to maintain the alignment so meticulously established during the set-up phase of the process. As described in the co-pending application, alignment aids are incorporated in the printed materials to aid the printer in maintaining alignment One cause of misalignment during a press run is lateral shifting of the web of lenticular material as it moves through the press. As is well-known in the art, the web of material traverses between an idler roll and an impression roll at each station along the press where a color is printed on the flat side of the web. Even minute sideways movement of the web which occurs, for example, due to vibrations, can significantly effect print quality. Another cause of run misalignment results from tension on the web as it moves through the press. The web material is plastic and is deformable by forces exerted on the web. The printing plates mounted on the press to print the images viewed through the lenticular material are produced using prepress materials whose dimensions conform to those of the unstressed lenticular material. Distortions in the web dimensions, as the web runs through the press, therefore also results in distortions in the printed product.

The present invention offers a solution to these problems which is both cost effective and readily implemented, so to further help produce high quality printed materials.

BRIEF SUMMARY OF THE INVENTION

Among the several objects of the present invention may be noted the provision of a guide roll for use on a printing press used in flexographic printing or the like to print images on a flat side of a web of lenticular lens material, the opposite side of web, on which lenticules are formed, bearing against the guide roll as the web is pulled through the press;

the provision of such a guide roll to be either the idler roll or impression roll between which the web of lenticular material is drawn as it moves through the press;

the provision of such a guide roll having at least one, and preferably a series or band of grooves formed on its outer surface, the grooves comprising flutes extending circumferentially about the roll;

the provision of such a guide roll in which the band of grooves corresponds in width to the width of the web of lenticular material drawn through the press;

the provision of such a guide roll in which the size of the grooves is such that one or more lenticules fit within the grooves so to prevent lateral movement of the web as the web is pulled through the press and maintain an alignment between the web and printing press established prior to a print run;

the provision of such a guide roll in which the grooves further prevent distortion of the web resulting from forces exerted on the web to draw it through the press;

the provision of such a printing press to have a plurality of print stations at which a color is printed on the web, each station having an associated guide roll, each guide roll having the grooves;

the provision of such lenticular material be of different sizes and have different numbers of lenticules with a separate guide roll, or set of guide rolls, being available for each separate material used;

the provision of such grooves to be of different patterns so that the grooves extend entirely across a guide roll, or are formed in bands spaced at intervals across the guide roll;

the provision of such a guide roll in which the surface area of the roll adjacent the grooves is appropriately contoured so as not to interfere with the fit of lenticules in the grooves; and, the provision of such a guide roll, or set of guide rolls, which are readily installed on a press to further help produce a high quality printed product.

In accordance with the invention, generally stated, at least one guide roll is for use on a printing press used to print an image on a flat surface of a web of a lenticular lens material. The opposite side of the web has a series of lenticules formed on it which extend parallel of each other longitudinally of the web and generally across the web. The surface on which the lenticules are formed is drawn across a guide roll as the web of material is pulled through the press. The guide roll has at least one, and preferably a band of circumferentially extending grooves formed on its outer surface, the width of the band corresponding to the width of the lenticular material. The grooves are each sized so one or more lenticules fit in them. As the web is drawn across the guide roll, the grooves prevent lateral movement of the web with respect to the press and distortion of the web due to forces exerted on it. This helps maintain a printing alignment established between the printing press and the web prior to a print run and results in a high quality printed product. The guide roll can be either the idler roll or impression roll depending upon the particular application. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
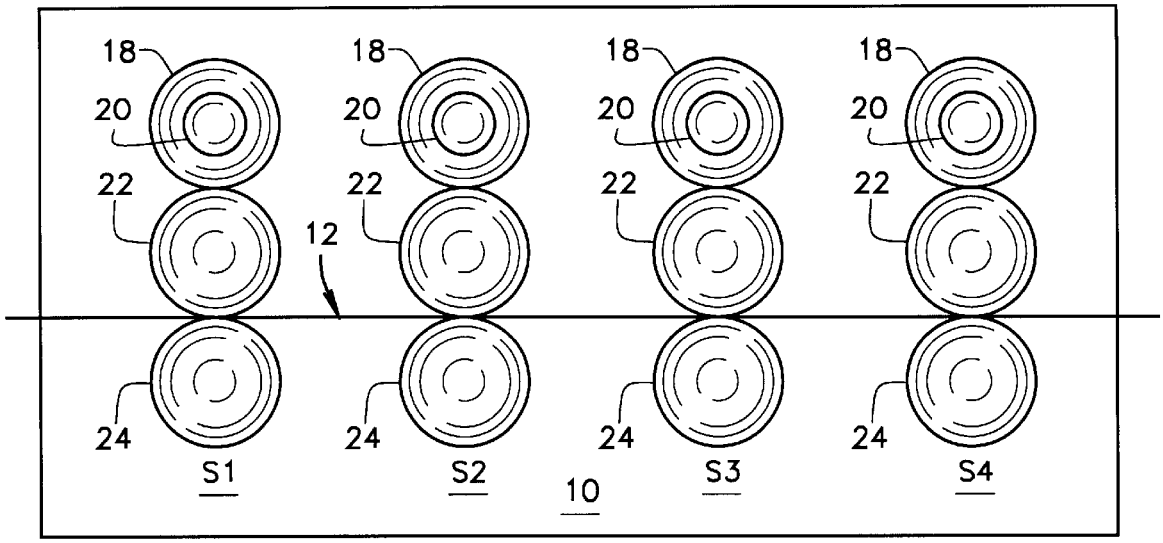
FIG. 1 is a simplified representation of a printing press through which a web of lenticular material is drawn.
Figure 2A:
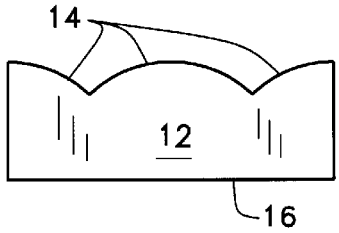
FIGS. 2A and 2B are end elevational views of sheets of lenticular material showing the flat and lenticular sides of the sheet.
Figure 2B:
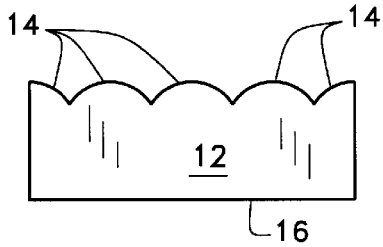

Referring to the drawings, a printing press indicated generally 10 in FIG. 1 is used to print a web 12 of lenticular lens material fed into the press from one end thereof. As shown in FIGS. 2A and 2B, the lenticular lens material has a plurality of lenticules 14 formed on one side of the web. The lenticules extend parallel of each other longitudinally of the web and generally across the width of the web. The other side 16 of the web is flat. As indicated in the drawings, the number of lenticules formed on the one side of the material may differ from one application to another. Typically, the number of lenticules is measured over the width of an inch and the lenticules per inch (LPI) may vary from under 100 LPI to close to 200 LPI.

Images printed on the lenticular material are printed on the flat side of the material and are viewed through the lenticules 14. Four basic colors (black, yellow, cyan, magenta) are normally used to print the images with each color being separately printed on the web of material. The colors are imprinted on surface 16 of the lenticular web in the form of dots of the particular color. In FIG. 1, four separate print stations S1–S4 are indicated with a particular color printed at each station. As part of the preparation process for a printing operation, a color separation is performed of the image to be printed. Printing plates 18 (one for each color) are prepared and each plate is fitted on a roller 20 at the appropriate station. A blanket or impression roll 22 is positioned beneath each roller 20, and a third roller 24 commonly referred to as an idler roller is located beneath each blanket roller. As web 12 is pulled through the press it passes between the impression and guide rolls 22, 24 at each station.

Figure 3:
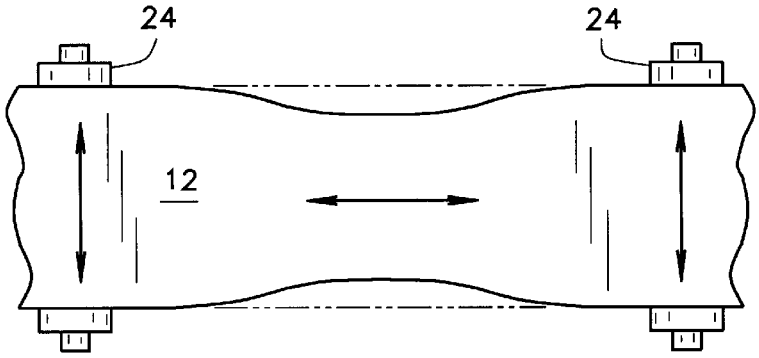
FIG. 3 is a simplified illustration of the distortion of a web of material as it is drawn through the press.

Referring to FIG. 3, it has heretofore been common that during a print run, the web 12 of lenticular material may shift laterally of the rollers as it moves through the press. As discussed above, this effects the alignment between the plates 18 and lenticular material established prior to the print run. Further, because of differences in tension exerted on the web at different points, longitudinal distortion also occurs. In this instance, the web stretches and its width is diminished from the dashed line width indicated in FIG. 3.

In accordance with the present invention, a guide roll is provided having at least one circumferentially extending groove G formed on an outer surface 26 of the roll. While the following discussion is with respect to use of idler roller 24 as the guide roll, it will be understood that impression roll 22 can also be used as the guide roll and, if so, its construction is the same as now described for the idler roller.

Figure 4:
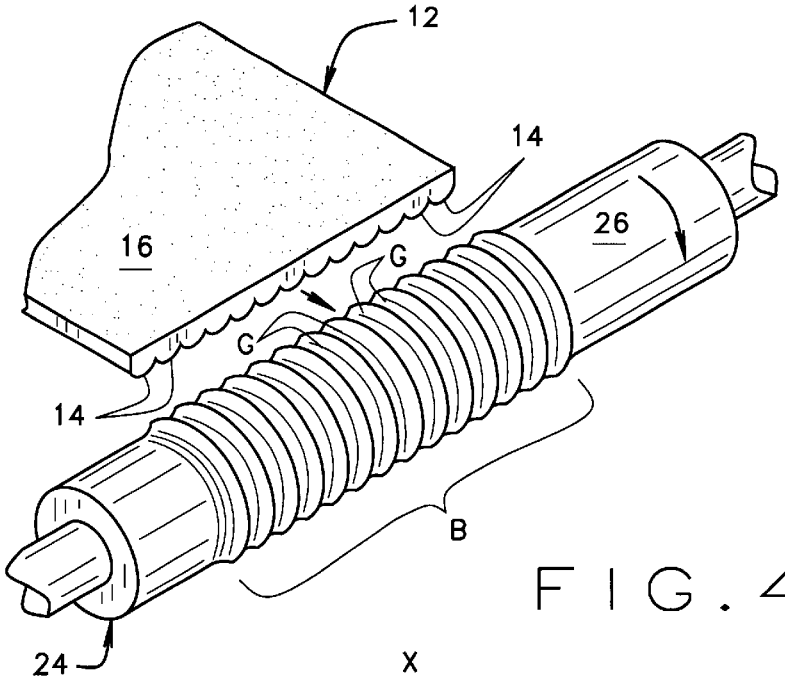
FIG. 4 is a perspective view of a guide roll of the present invention.
Figure 5A:
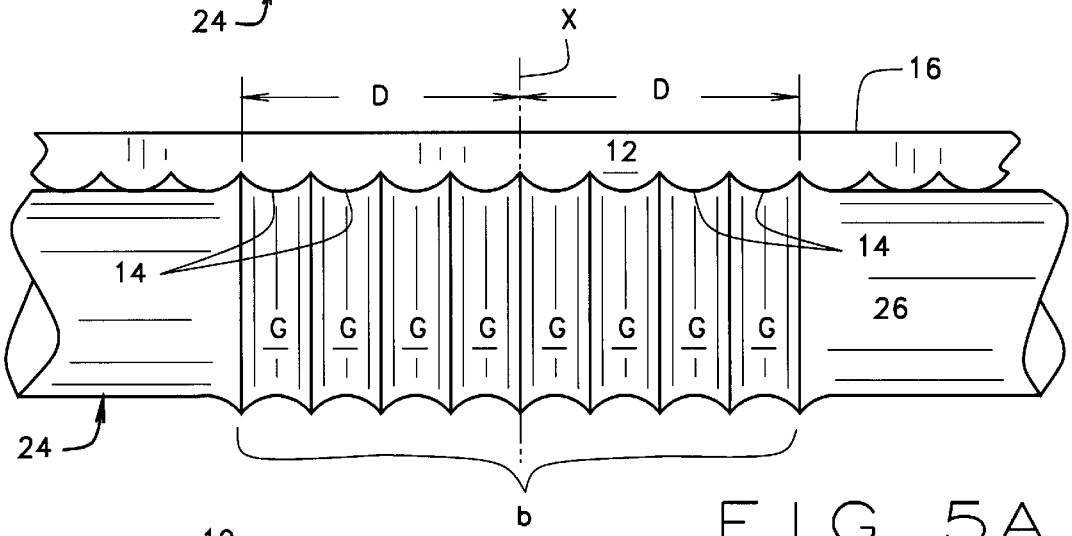
FIGS. 5A and 5B are respective elevational views of a section of the guide roll.
Figure 5B:
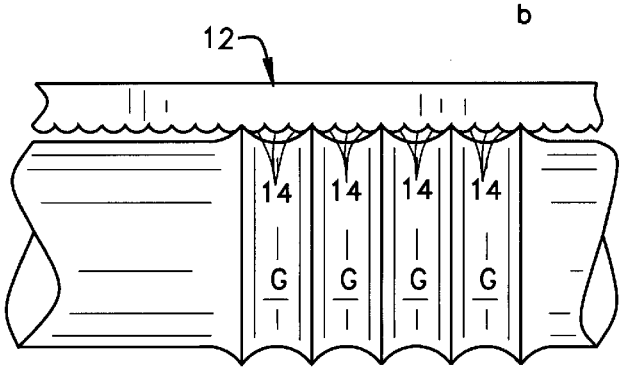
Figure 6A:
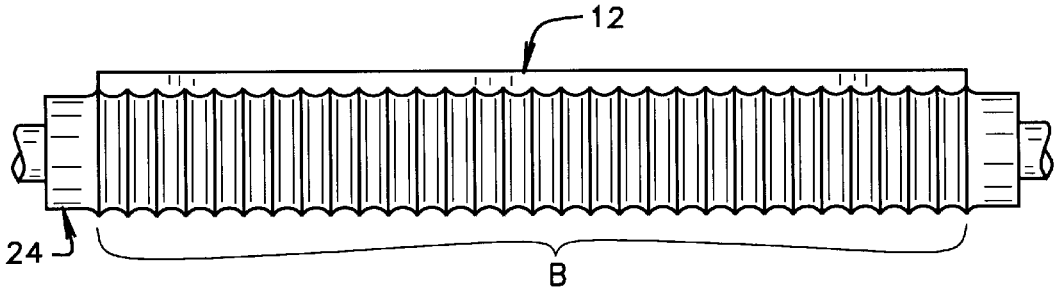
FIGS. 6A and 6B illustrate alternate patterns of grooves on a guide roll in accordance with the present invention; and, FIG. 7 illustrates a set of guide rolls of the present invention used on a printing press.
Figure 7:
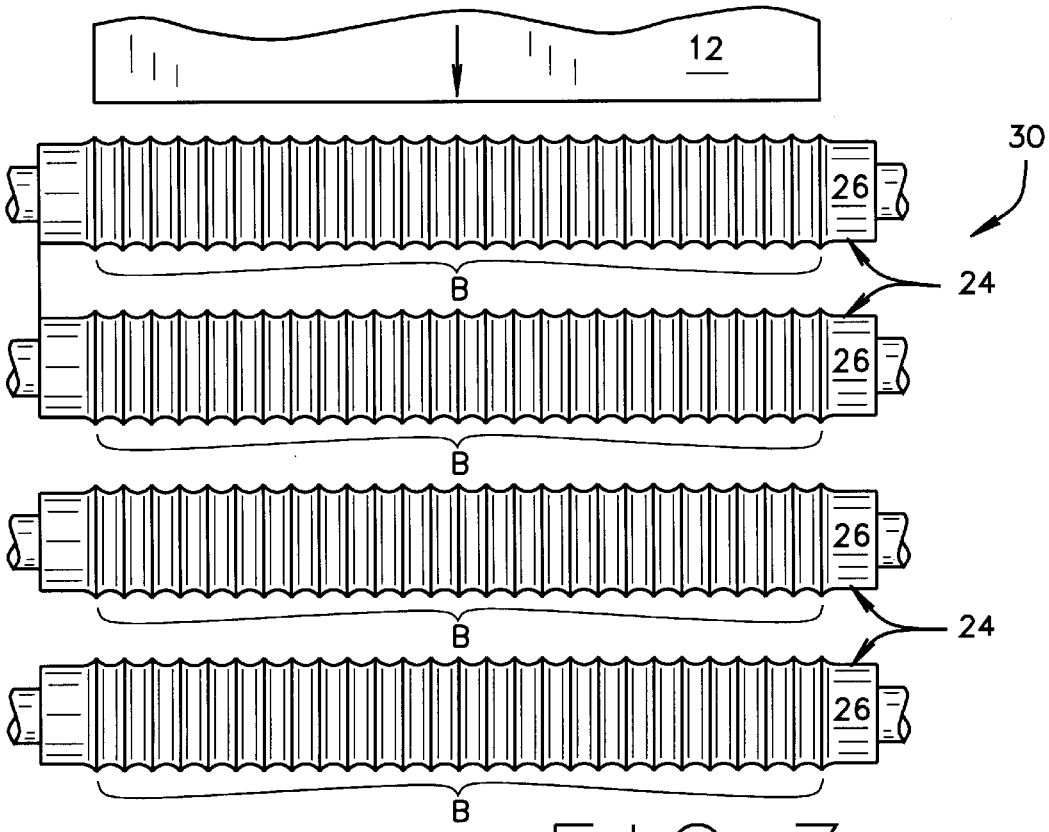

As shown in FIG. 5A, a groove G is sized for at least one lenticule 14 to fit into the groove. As shown in FIG. 4, for example, idler roller 24 has a plurality of identically formed grooves G formed in its outer surface. Preferably, and as shown in FIGS. 4, 6A and 7, the width of this band B of grooves corresponds to the width of the web 12 of lenticular material. Each groove G comprises a separate fluting formed in the outer surface 26 of the idler roller. As further shown in FIG. 5A, each groove G is sized to accommodate at least one lenticule 14. Or, as shown in FIG. 5B, the groove can be formed so a plurality of lenticules 14 is accommodated in the groove. The grooves are formed so as to extend across the idler roller in a side-by-side relationship with band B of adjacently formed grooves extending across idler roller 24.

Provision of a groove or band of grooves in the guide roll accomplishes a number of things. First, it enables the idler roller to guide movement of web 12 through the press. Second, in doing so, the grooves prevent lateral movement of the web with respect to the idler roller as the web moves between print stations. This maintains the relationship of the web to the printing plate and rollers established before the print run. Third, the grooves prevent distortion of the web by the tension forces exerted on the web. In this regard, pulling on the web in a longitudinal direction causes the portion of web between the rollers to stretch which, in turn, decreases the width not only of the web, but also of each lenticule formed on the one side of the web. As the width of each lenticule shrinks, adjacent lenticules are pulled closer together to each other. However, if a lenticule is constrained in a groove G, the sidewalls of the groove create a physical barrier which prevents the lenticules from moving closer to each other. In doing so, the grooves produce a force counteracting the forces of distortion and the web retains its original dimensions. Accordingly, the guide roll of the present invention helps maintain the alignment established prior to a print run and a better printer product results.

Figure 6B:
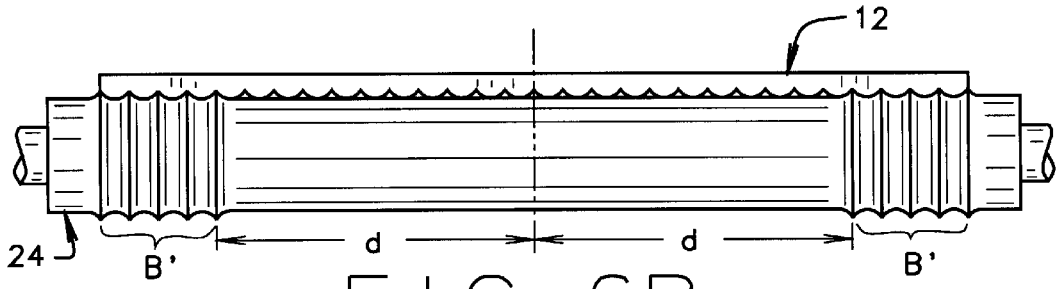

As shown in FIG. 5A, if a band b of grooves only extends across a portion of the idler roller's width, the band is generally centered across the idler roller. That is, the band of grooves is centered about a central diameter X of the idler roller and extends a predetermined distance D on either side of this central diameter as indicated in FIG. 5A. However, as shown in FIG. 6A, the band of grooves can extend completely across the width of idler roller 24 from one side of the roller to another. Or, as shown in FIG. 6B, rather than having a single band of grooves centered on the idler roller, separate bands B' of grooves G are formed on opposite ends of the idler roller. In this embodiment, the groove of each band is a distance d from the central diameter of the roller. Although not shown in drawings, those skilled in the art will appreciate that other groove formations are also possible. For example, there could be a central band of grooves, and additional bands formed on the outer ends of the roller. Or, there could be a plurality of bands spaced across the width of the roller.

Whether or not each groove G is formed so to accommodate only a single lenticule as shown in Fig, 5A, or a number of adjacent lenticules as shown in FIG. 5B, outer surface 26 of idler roller 24, adjacent the outer grooves forming a band, is contoured so lenticules 14 adjacent those fitting in the grooves contact the outer surface of the idler roller with their apices residing or resting on the roller on surface 26 as web 12 is drawn across the guide roll. This is as shown in FIG. 5A in which the lenticules 14 not fitting in the grooves G rest upon the outer surface of the idler roller. This idler roller construction ensures that there is no distortion to flat side 16 of the web on which the image is being printed.

Referring again to FIG. 1, there is a separate idler roller 24 employed at each print station S. For purposes of the present invention, only one of these idler rollers need have the grooves G formed thereon in order to prevent the problems previously discussed. However, and as shown in FIG. 7, each of the idler rollers can have a band of grooves formed in them resulting in a set 30 of guide rolls. In FIG. 7, each idler roller has an identical band B of grooves formed on the outer surface 26 of each roller 24. However, although not shown in the drawings, different rollers 24 can have their band of grooves differently located. Also, as previously discussed with respect to FIGS. 2A and 2B, different lenticular materials have different LPI's. It is a feature of the present invention that a separate idler roller 24, or a set 30 thereof, be provided for each lenticular material having an LPI different from that of a material previously run on the press.

What has been described is a guide roll which can be an impression roller or idler roller, or set of such rollers, for use on flexographic or other printing presses to print images on one side of a web of a lenticular lens material. Each idler roller preferably has a band of grooves formed on its outer surface and extending generally the width of the guide roll, the grooves being comprised of flutes extending circumferentially about the roller. The size of each groove is such that one or more lenticules fits within the groove. This prevents lateral movement of the web with respect to the roller as the web is pulled through the press. Also, the grooves prevent distortion of web along its longitudinal axis due to forces exerted on the web to draw it through the press. Since different lenticular materials have different LPI's, a separate guide roller, or set of guide rollers, is available for use with each separate material. The pattern of grooves can vary to include not only a single band of grooves, but also a single groove, a single band of grooves, or bands of grooves formed at spaced intervals across the roller. The outer surface of the guide roll adjacent the grooves is appropriately contoured so to not interfere with the fit of lenticules in the grooves. Finally, the idler roller, or set of rollers, is readily installed on a press. Use of the rollers with the grooves helps create a high quality printed product.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A guide roll in combination with a printing press used to print images on a flat surface of a web of a lenticular lens material, an opposite surface of said web having lenticules of known and predetermined size and boundary formed thereon which extend generally parallel of each other longitudinally of the web and generally across the width of the web, said guide roll having at least one circumferentially extending groove formed on an outer surface thereof and sized so that the boundary of at least one lenticule of said web seats in said groove, said lenticular surface being drawn over the guide roll as said web is run through the press, and said groove guiding movement of said web through the press to prevent lateral movement of the web as it moves through the press and to prevent distortion of the web caused by forces exerted thereon, said guide roll thereby maintaining an alignment established between the printing press and said web prior to beginning a printing run.

2. The guide roll of claim 1 wherein said guide roll is an idler roller of said press and wherein said groove comprises a circumferential fluting formed in an outer surface of said idler roller and accommodating said at least one lenticule.

3. The guide roll of claim 1 wherein said guide roll is an impression roller of said press and wherein said groove comprises a circumferential fluting formed in an outer surface of said impression roller and accommodating said at least one lenticule.

4. The guide roll of claim 1 further including a plurality of grooves formed in said outer surface of said guide roll.

5. The guide roll of claim 4 wherein said grooves comprise a band of grooves adjacently formed and extending across said guide roll, the width of the band of grooves substantially corresponding to the width of said web.

6. The guide roll of claim 4 wherein said grooves are adjacently formed as a band, centered about a central diameter of said guide roll, and extend a predetermined distance to either side of said central diameter.

7. The guide roll of claim 4 wherein said grooves comprise a first set of adjacently formed grooves formed on one side of said guide roll, and a second set of adjacently formed grooves are formed on an opposite side thereof.

8. The guide roll of claim 4 wherein said outer surface of said guide roll adjacent said grooves has a diameter sized so that lenticules not accommodated within said grooves contact said outer surface of said guide roll as said web is drawn across said guide roll.

9. In a printing press having a plurality of print stations at each of which a separate color of an image is printed on a flat surface of a web of a lenticular lens material, an opposite surface of the web having a series of lenticules formed thereon which extend parallel of each other longitudinally of the web and generally across the web, the improvement comprising:

a plurality of guide rolls, one for each print station, said surface on which said lenticules are formed being drawn across each guide roll as said web of material is pulled through the press; and, each guide roll having a series of circumferentially extending grooves formed on an outer surface thereof, each groove accommodating at least one lenticule therein so that as said web is drawn through said press and across each guide roll said grooves guide the movement of said web, and prevent lateral movement of the web and distortion of the web thereby to maintain a printing alignment established between the printing press and said web prior to a printing run.

10. The improvement of claim 9 wherein said grooves comprise a band of grooves adjacently formed and extending across each guide roll, the width of the band of grooves substantially corresponding to the width of said web.

11. The improvement of claim 9 wherein said grooves are adjacently formed as bands, respectively centered about a central diameter of said respective guide roll, and extend a predetermined distance to either side of said central diameter.

12. The improvement of claim 9 wherein said grooves are adjacently formed as bands, said bands of grooves comprising a first set of grooves formed on one side of each said guide roll, and a second set of grooves formed on an opposite side thereof.

13. The improvement of claim 9 wherein different webs of said lenticular lens material are of a different width and have different numbers of lenticules formed thereon, and the improvement comprises a separate set of guide rolls for use on said printing press for said different webs.

14. The improvement of claim 9 wherein each said guide roll comprises an idler roller of said press and wherein said groove comprises a circumferential fluting formed in an outer surface of said idler roller and accommodating said at least one lenticule.

15. The improvement of claim 9 wherein each said guide roll comprises an impression roller of said press and wherein said groove comprises a circumferential fluting formed in an outer surface of said impression roller and accommodating said at least one lenticule.

16. A method of printing an image on a web of a lenticular lens material having a flat surface on which said image is printed and an opposite surface on which a plurality of lenticules are formed and through which said image is viewed, said lenticules extending parallel of each other longitudinally of the web and generally across the web, the method comprising;

drawing said side of said web on which said lenticules are formed across a guide roll located at at least one station of said printing press at which a color comprising said image is printed on said flat surface of said web; and, providing at least one circumferentially extending groove in an outer surface of said guide roll, said groove accommodating at least one lenticule therein for guiding said web through said station, preventing lateral movement of said web as it passes through said station, and longitudinal distortion of said web as it passes through said press whereby a print alignment between said web and press established before a print run is maintained.

17. The method of claim 16 further including providing a plurality of grooves in said outer surface of said guide roll, said grooves comprising a band of adjacently formed grooves extending across said guide roll, the width of said band generally corresponding to the width of said web.

18. The method of claim 16 further including providing a plurality of stations at which a color forming said image is printed on said web; and providing a set of guide rolls, one for each station at which a color forming said image is printed on said web, each guide roll having a series of identically formed grooves formed on an outer surface thereof, said grooves accommodating said lenticules therein so as said web is drawn through said press and across each guide roll there is no lateral movement of said web with respect to said guide roll at that station.

19. The method of claim 16 wherein said step of drawing said side of said web on which said lenticules are formed across a guide roll located at at least one station of said printing press at which a color comprising said image is printed on said flat surface of said web includes drawing said side of said web on which said lenticules are formed across a guide roll located at a plurality of stations of said printing press at which a color comprising said image is printed on said flat surface of said web;

the method further including providing a set of guide rolls, one for each of said plurality of stations at which a color forming said image is printed on said web, each guide roll having a series of identically formed grooves formed on an outer surface thereof, said grooves accommodating said lenticules therein so as said web is drawn through said press and across each guide roll there is no lateral movement of said web with respect to said guide roll at that station.

* * * * *